US005260099A

United States Patent [19]

Haskell

[11] Patent Number: 5,260,099

[45] Date of Patent: Nov. 9, 1993

[54] METHOD OF MAKING A GAS TURBINE BLADE HAVING A DUPLEX COATING

[75] Inventor: Roger W. Haskell, Scotia, N.Y.

[73] Assignee: General Electric company, Schenectady, N.Y.

[21] Appl. No.: 932,925

[22] Filed: Aug. 20, 1992

Related U.S. Application Data

[60] Continuation of Ser. No. 749,199, Aug. 23, 1991, abandoned, which is a division of Ser. No. 516,450, Apr. 30, 1990, Pat. No. 5,098,797.

[51] Int. Cl.[5] ..... B05D 3/12

[52] U.S. Cl. ..... 427/367; 427/376.2; 427/376.5; 427/380; 427/383.7

[58] Field of Search ..... 427/192, 203, 328, 383.9, 427/376.5, 419.2, 380, 405, 367, 376.2

[56] References Cited

U.S. PATENT DOCUMENTS

| | | | |
|---|---|---|---|
| 1,565,495 | 12/1925 | Pfeil | 427/192 |
| 3,248,251 | 4/1966 | Allen | 106/286 |
| 3,261,673 | 7/1966 | Wheildon | 428/632 |
| 3,754,976 | 8/1973 | Bobecki et al. | 427/192 |
| 3,959,030 | 5/1976 | Sarake et al. | 427/328 |
| 4,329,402 | 3/1982 | Hyner et al. | 428/621 |
| 4,391,854 | 7/1983 | Kanda et al. | 427/192 |
| 4,401,697 | 8/1983 | Strangman | 427/328 |
| 4,485,151 | 11/1984 | Stecura | 428/680 |
| 4,576,874 | 3/1986 | Spangler et al. | 428/633 |
| 4,650,699 | 3/1987 | Mosser et al. | 427/240 |
| 4,761,346 | 8/1988 | Naik | 428/680 |
| 4,797,329 | 1/1989 | Kilbane et al. | 428/629 |
| 4,965,095 | 10/1990 | Beldi | 427/328 |

*Primary Examiner*—Terry J. Owens
*Assistant Examiner*—Benjamin L. Utech
*Attorney, Agent, or Firm*—Schmeiser, Morelle & Watts

[57] ABSTRACT

A stainless steel gas turbine engine compressor blade is protected against corrosion by providing a thin sacrificial coating in the form of a coherent aluminum body in electrically-conducting contact with the blade surface, then overcoating the aluminum coat with a phosphate-chromate mixture in organic vehicle and drying and heating to cure and repeating the overcoating step several times to harden and densify the resulting ceramic body.

2 Claims, 5 Drawing Sheets

METHOD OF MAKING A GAS TURBINE BLADE HAVING A DUPLEX COATING

This application is a continuation of application Ser. No. 07/749,199, filed Aug. 23, 1991 (now abandoned) which is a division of application Ser. No. 516,450 filed on Apr. 30, 1990 from which U.S. Pat. No. 5,098,797 was issued on Mar. 24, 1992.

FIELD OF THE INVENTION

The present invention relates generally to the corrosion protection branch of the metallurgical art, and is more particularly concerned with novel corrosion-resistant composite articles such a steel gas turbine engine components having a protective duplex coating, and with a new method for making them.

BACKGROUND OF THE INVENTION

Steel components of industrial and marine gas turbine engines are subjected in normal use to a variety of operating conditions, particularly in terms of the ambient atmosphere. In some situations the air drawn into the engine has constituents which are corrosive and abrasive to the compressor blades and other such parts in spite of their relatively high chromium content and generally corrosion resistant nature. It has been proposed, consequently, that a protective coating be provided against such corrosive attack and while various metallic coatings have been suggested and tried, none has qualified for technical or economic reasons. Ceramic coatings have also been proposed, but have not solved the problem because even the most rugged of them are chipped and broken in normal gas turbine engine operation, exposing the underlying steel surfaces to corrosive attack.

SUMMARY OF THE INVENTION

By virtue of this invention, based on new concepts and discoveries of mine detailed below, the problem of corrosion of compressor blades and other martensitic steel parts of gas turbine engines operating in hostile environments has been solved. Thus it is now possible for the first time, to my knowledge, to provide the corrosion protection necessary for such components for long term service life under the most corrosive ambient air operating conditions. Further, this result is gained at reasonable cost and without significant offsetting disadvantage.

In essence, this invention is predicated upon my novel concept of using a ceramic coating and solving the chipping and breakage problem of such coatings by providing a sacrificial undercoat of metallic material bonded to the surface of the substrate article and to the ceramic overcoat as well. The surface of a compressor blade or other steel part protected in this manner is not initially exposed to ambient air through the ceramic overcoat and is so shielded in spite of chipping and breakage of the ceramic overcoat for as long as the sacrificial metallic layer remains intact.

I have found that when the sacrificial undercoat is exposed through breaks in the ceramic overcoat, it takes an unexpectedly long time for corrosive action to work its way through the metallic undercoat. Further, I have found, surprisingly, that even after penetration of the undercoat, the sacrificial metallic material in the immediate area serves to protect the exposed surface of the steel substrate from corrosive attack.

Moreover, I found that this prolonged protective effect is obtained through the use of sacrificial metallic coatings which may be extremely thin and may even have defects or openings of width as great as 1/16-inch produced during manufacture or service.

Another of my concepts is the use for the sacrificial undercoat of any suitable metal or alloy of metal standing above iron in the electromotive force series. This, of course, does not include those highly reactive metals such as sodium and potassium, but does include aluminum, zinc, cadmium and magnesium and those of their alloys which are more active in a galvanic series than iron and consequently will serve the sacrificial purpose of this invention.

I have further found that the sacrificial undercoat can be applied in various ways with consistently good results. Thus nickel-cadmium and nickel-zinc primary coats have been electroplated to provide sacrificial undercoats of good coverage and adhesion at minimal cost. Aluminum undercoats of similar good quality have been produced through the use of aluminum paints by dipping, spraying or brushing followed by drying, heat treating and grit blasting or otherwise burnishing to consolidate the particulate metallic residue and thereby produce a coherent aluminum body in electrically-conductive contact with the surface of a metallic substrate. Other deposition techniques for this purpose include plasma-and flame-spraying, sputtering, ion vapor deposition (IVD), physical vapor deposition (PVD) and chemical vapor deposition (CVD).

Sacrificial metal coat thickness is generally not critical as the new results and advantages of this invention can be consistently obtained with coatings as thin as about 0.2 mil and as much thicker as may be desired.

Additionally, I have found that the ceramic overcoat can be applied by the process described in detail in U.S. Pat. No. 3,248,251 issued to Allen on Apr. 26, 1966. The initial resulting ceramic overcoat then is closed and sealed by a second coat and a third, if desired, and drying and curing steps are carried out following each coating step.

Finally, I have discovered that the conflicting temperature requirements of ceramic coat production (generally 1000° F. or higher) and stainless steel fatigue resistance retention (less than about 600° F. ) can be overcome with consistently good results. Specifically, I have found that by limiting the temperature of the drying and curing steps of the Allen process to less than about 600° F., preferably 500°-550° F., a good ceramic overcoat can be provided without sacrificing fatigue resistance of the stainless steel substrate established in the course of production by shot peening or other suitable cold-work treatment.

Described broadly and generally, a novel martensitic stainless steel article such as a compressor blade of this invention bears a duplex coating of a sacrificial metallic undercoat and a protective ceramic overcoat, the two coats being bonded to each other and the undercoat being bonded to the surface of the blade to provide a unitary composite article.

Likewise described in general terms, the method of this invention comprises the steps of providing a gas turbine engine compressor blade, establishing a continuous sacrificial metallic coat of minimum thickness on the surface of the blade, and forming a ceramic coat over the sacrificial metal coat and bonded thereto.

BRIEF DESCRIPTION OF THE DRAWINGS

Those skilled in the art will gain a further and better understanding of this invention upon consideration of the drawings accompanying and forming a part of this specification, in which.

DETAILED DESCRIPTION OF THE INVENTION

Figure 1:
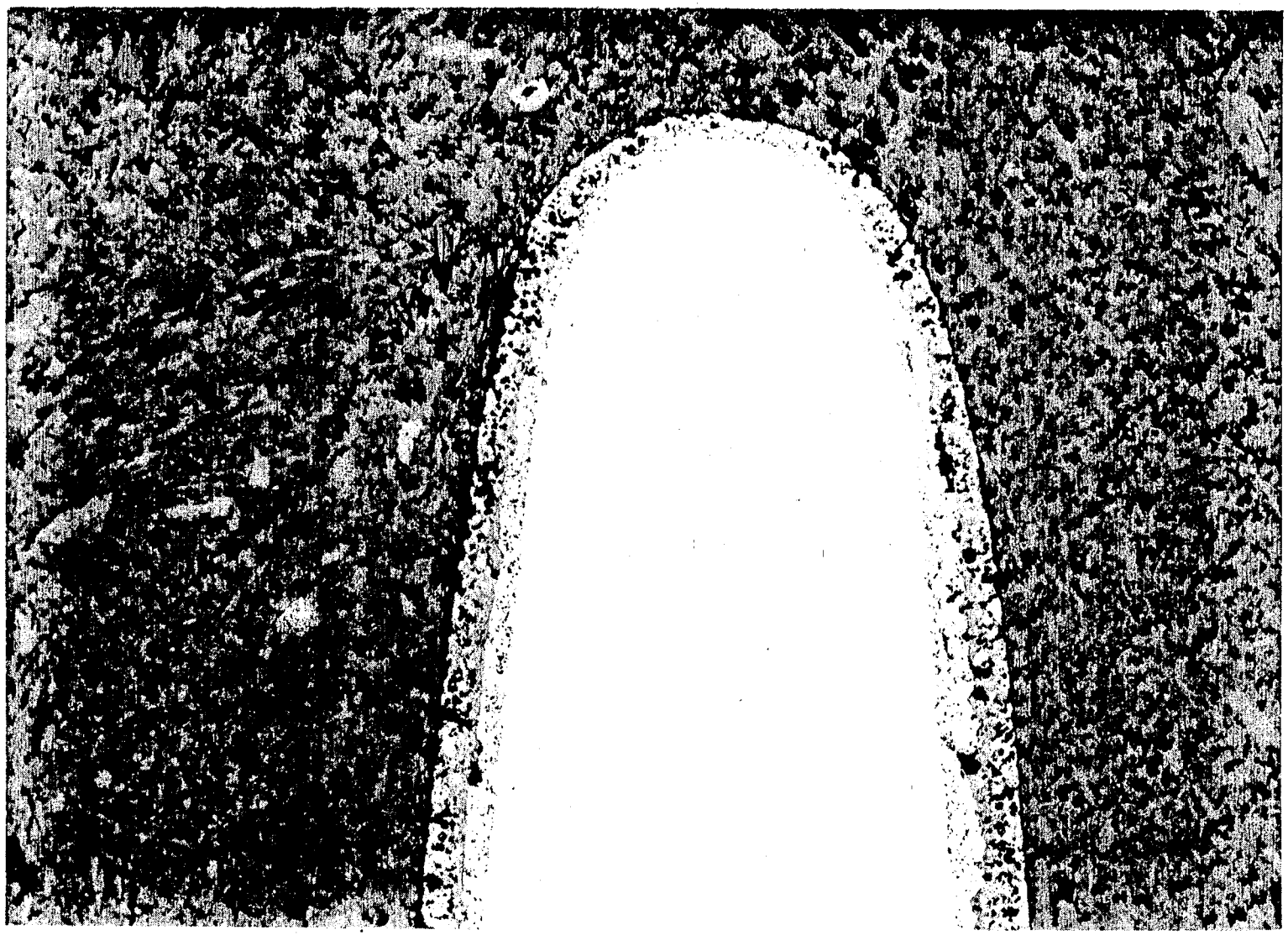
FIG. 1 is a photomicrograph (100×) of a portion of the cross-section of a composite gas turbine engine compressor blade of this invention showing the duplex aluminum-ceramic protective coating system bonded to the blade surface.
Figure 2:
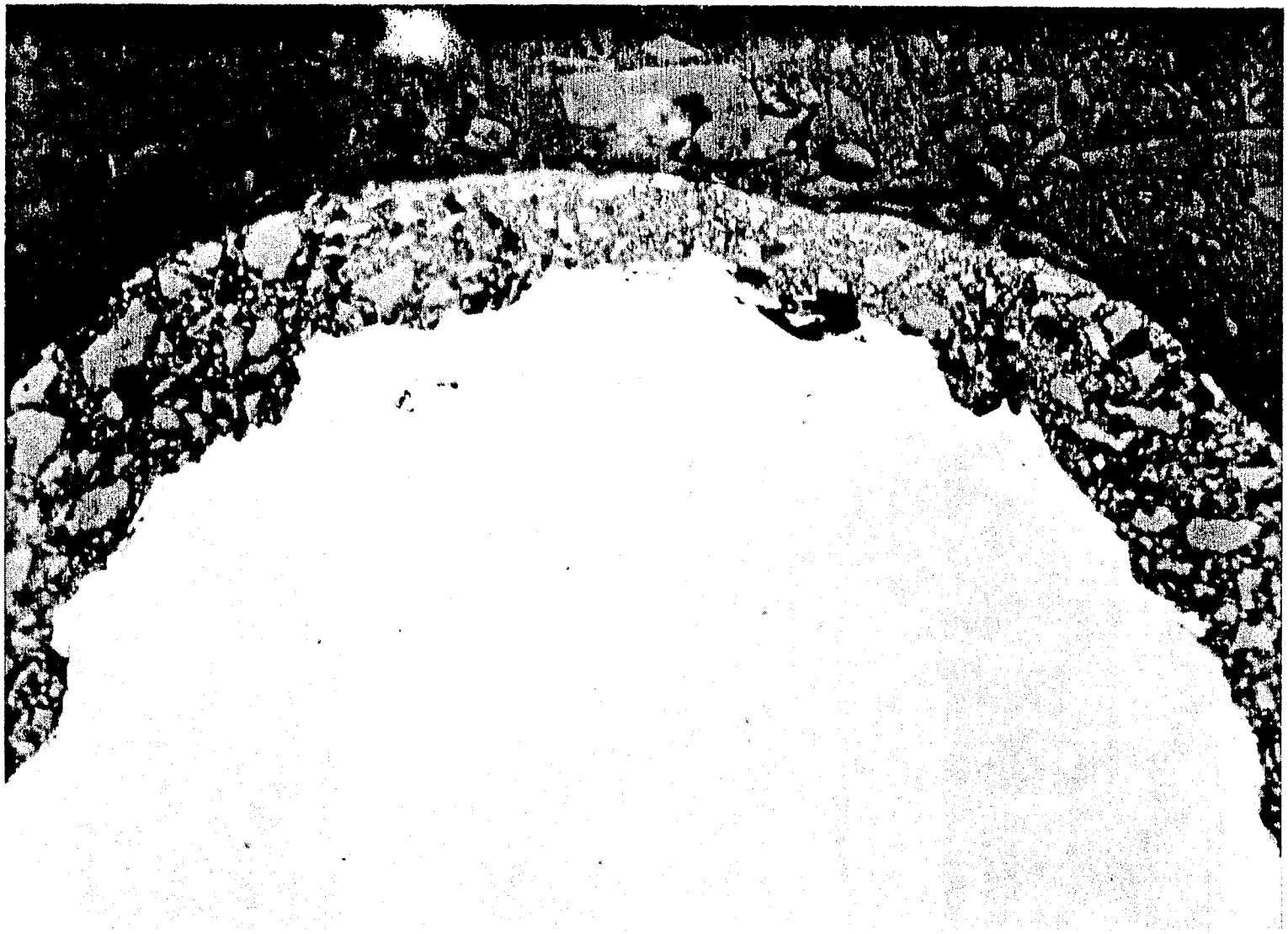
FIG. 2 is a photomicrograph (500×) of another compressor blade like that of FIG. 1 bearing a duplex coating of nickel-cadmium primary coat overlaid with a ceramic coat.

In the practice of this invention in a presently preferred form, the clean surface of a gas turbine engine compressor blade of 403 stainless steel is initially provided with a continuous relatively-thin, sacrificial metal coat. As indicated above, a nickel-cadmium coat is used for this purpose and is electroplated to thickness of about 0.2 to 0.4 mil, preferably 0.3 mil. The resulting hard, primary coat is then overcoated with ceramic by the method described in the U.S. Pat. No. 3,248,251 issued Apr. 26, 1966 to Charlotte Allen, the disclosure of which is incorporated herein by reference.

As alternative procedures, the sacrificial metal undercoat may be provided by flame or plasma spraying techniques in common use, or preferably by applying a metallic paint to the substrate surface initially prepared by grit blasting and then drying, heating to cure and then consolidating the metal powder in contact with the metallic surface suitably by glass bead blasting. Generally, a single application will be sufficient to produce an adequate metal coat of at least about 3 mils thickness for the purposes of this invention.

Bonding of the sacrificial metal coat to the protective overcoat of ceramic material is not a problem when the method of establishing the overcoat is as generally described above and detailed below. Thus the undercoat will receive the ceramic as it is applied and bond thereto in an interlocking effect securely holding the overcoat in place on the composite article. Preparation of the surface of the sacrificial metal coat as necessary to secure bonding of the ceramic overcoat is preferably done by grit blasting to roughen the metal surface.

This invention is further described and distinguished from the prior art by the following illustrative, but not limiting, examples of actual practice.

EXAMPLE I

A test specimen ga turbine blade of A1S1 403 stainless steel was cleaned and then provided with nickel-cadmium alloy electroplate of uniform thickness approximately 0.3 mil grit blasted to roughen the electroplate surface and then overcoated with a ceramic body of uniform thickness about three mils. The ceramic overcoat was provided by dipping the specimen into a slurry of composition set forth in Table I, and slurry overcoat was dried and fired at 600° F. for one hour. In this instance the ceramic was hardened by impregnating eight times using a phosphoric-chromic acid solution (50% concentrated phosphoric acid and 50% saturated chromium trioxide). After each impregnation the specimen was dried and fired at 600o F for one hour. The resulting duplex coating, which was lightly burnished between impregnations to achieve surface finish requirements had a smooth brown glassy finish which measured Ra=8 microinches on a profilemeter. The specimen showed no surface rust after 200 hours in the ASTM B117 salt fog test.

TABLE 1

| Ceramic Overcoat Slurry Composition | |
|---|---|
| CrO3 | 48 gm |
| SiO2 (fumed) | 155 gm |
| Al2O3 | 132 gm |
| H3PO4 (con) | 35 cc |
| H2O (deionized) | 164 cc |

EXAMPLE II

Figure 3:
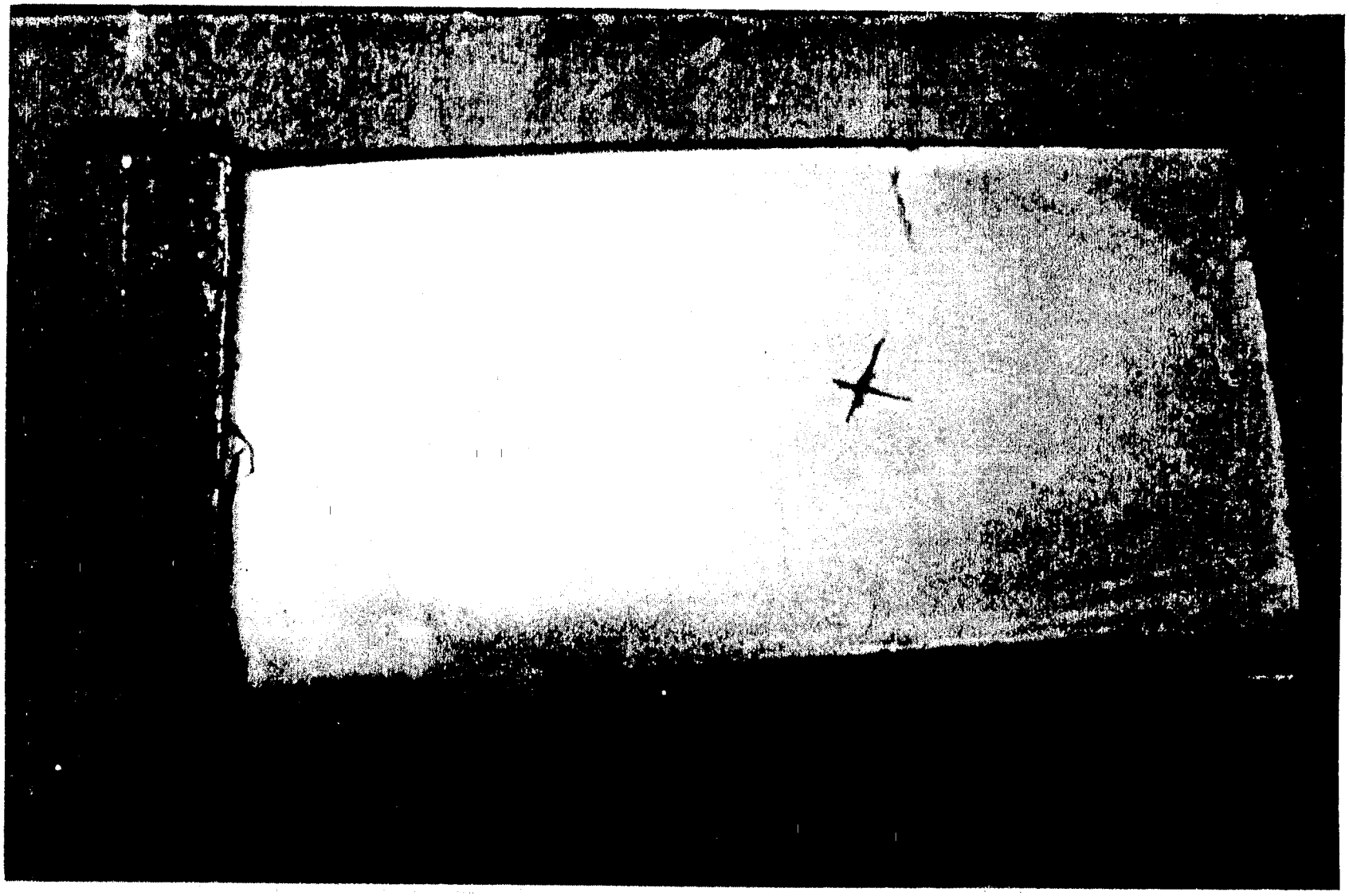
FIG. 3 is a photograph of the compressor blade of FIG. 2 bearing a rust-free scratch after 227-hours exposure to an ASTM B117 salt fog test.

Another test specimen gas turbine engine compressor blade of AlSl stainless steel similar to that of Example I was provided with a nickel-cadmium electrocoat approximately 0.3 mil in thickness, grit blasted and then overcoated with a ceramic body of uniform thickness about 3 mils. The procedure used was that of Example I, except that the slurry contained zirconia instead of alumina and was sprayed instead of being used as a dipping bath. The duplex-coated specimen was scratched with a carbide tool and then subjected to the ASTM B117 salt fog test for 227 hours with the result that, as shown in FIG. 3, there was no corrosion of the blade.

EXAMPLE III

Figure 4:
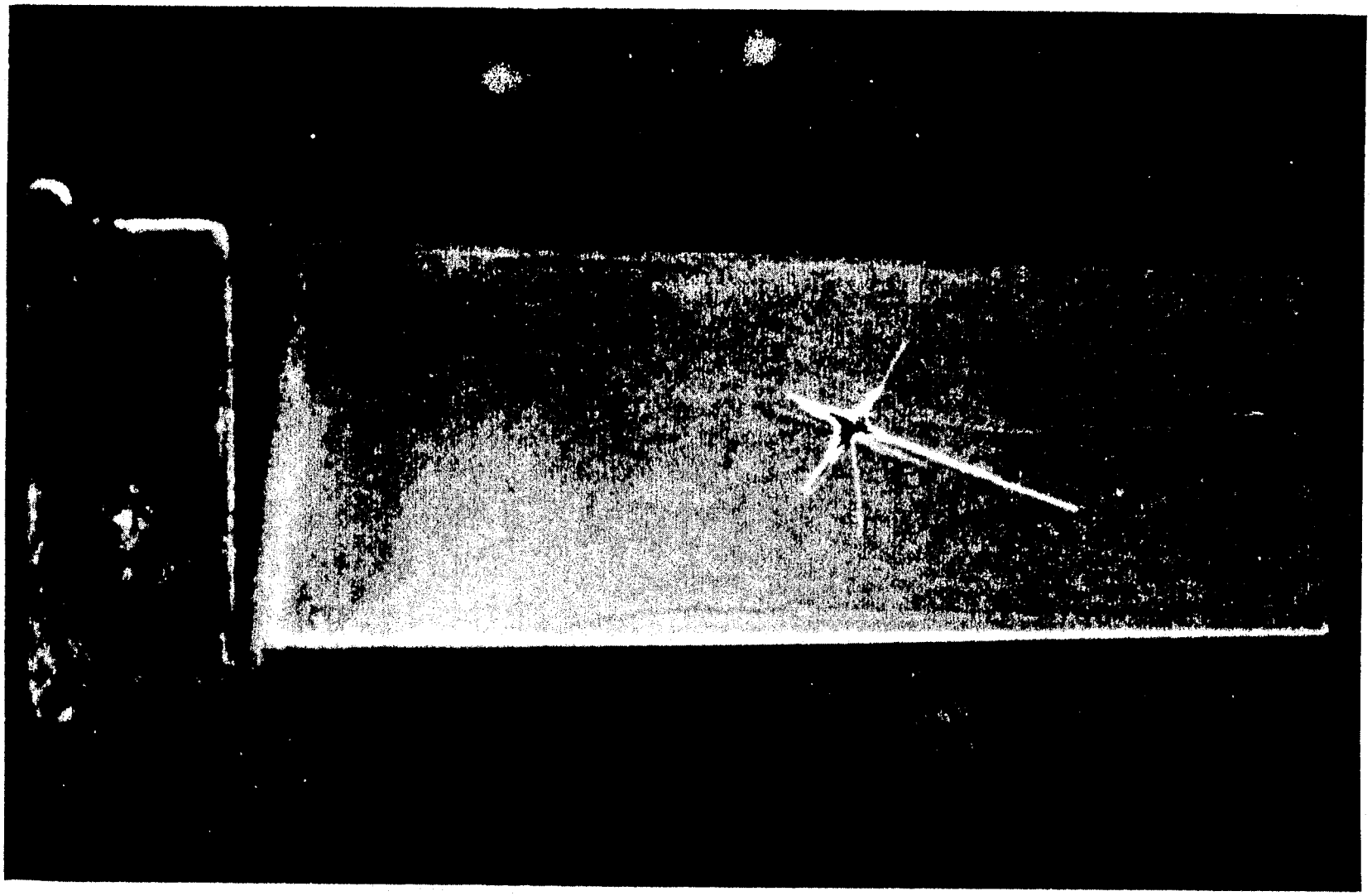
FIG. 4 PRIOR ART
FIG. 4 is a photograph (magnification on about 1.6) of a gas turbine engine compressor blade having a ceramic coat, but no metal undercoat, bearing a scratch and rust after exposure to the FIG. 3 test conditions.
Figure 5:
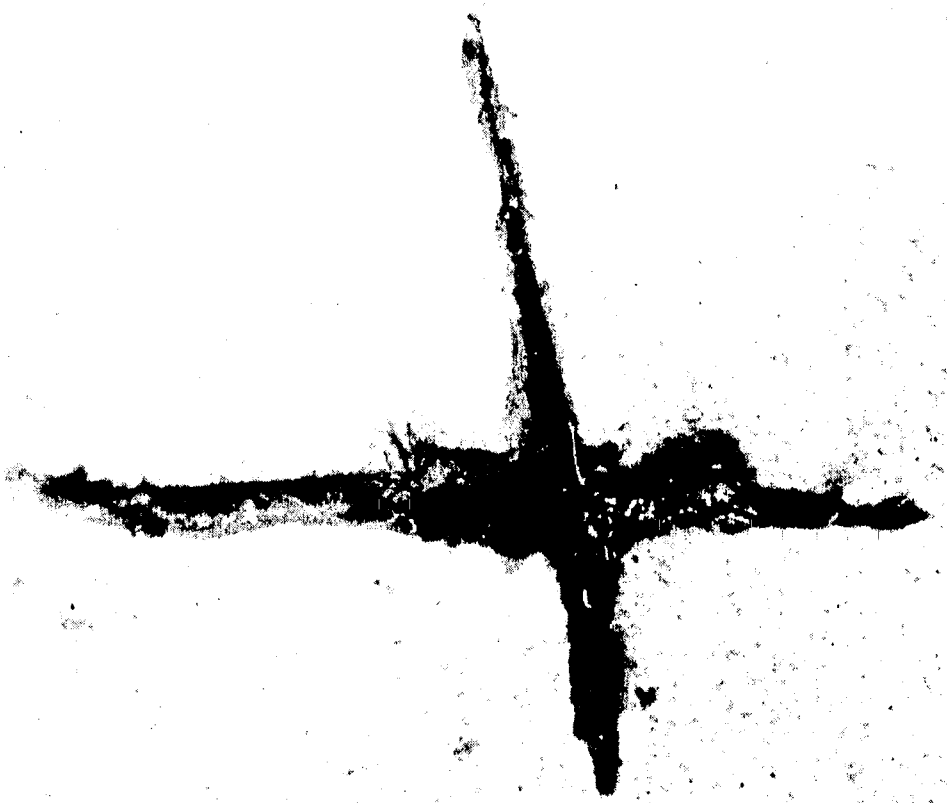
FIG. 5 PRIOR ART
FIG. 5 is an enlargement (about 12×) of the FIG. 4 photograph in the region of the scratch showing the extent of rust development when no undercoat of this invention is present.

A counterpart of the compressor blade specimen of Examples I and II was tested in the same manner with the result that the specimen was corroded, as shown in FIGS. 4 and 5. This specimen, unlike that of Examples 1 and II, was not provided with a metal undercoat but had Only a ceramic coat the same as that of Example II in respect to thickness, composition and method of application.

EXAMPLE IV

Recently, experience has been gained in the field with this invention as gas turbine inlet guide vanes having nickel-cadmium undercoats and ceramic overcoats provided as described in Example II were installed and used in engines at two different sites. Although inlet guide vanes are generally the most severely attacked of all the vanes in the compressor, these blades embodying this invention have logged over 1000 hours of operation without showing any evidence of corrosion.

EXAMPLE V

A test specimen the same as that of Example I was provided with a base coat of aluminum by spraying on the specimen surface an aluminum-containing paint (marketed as Alseal TM 518 by Coatings of Industry, Souderton, Pa). The specimen was then heated to 500°-550° F. for one hour and thereafter glass bead blasted with alumina to consolidate the aluminum particles of the paint residue into a continuous sheet providing an electrically conducting covering in contact with the martensitic steel substrate. A phosphate-chromate mixture with an organic vehicle was then applied on the primary coat as per Alseal product data instructions, after which the specimen was dried and heated at about 500°-550° F. for a few hours. Thereafter a ceramic overcoat was applied by the procedure and with the slurry formulation of Example II. The resulting product is shown in FIG. 1.

The ASTM B117 salt fog tests reported above were conducted in accordance with standard procedure, the test specimens were each subjected to a fog consisting of droplets of 5% aqueous sodium chloride, the fog settling rate being 1-2 cubic centimeters per hour over 80 square centimeters and the temperature being maintained at 95° F. throughout the test period of 227 hours. This test was selected for the purpose because it is generally recognized as specially useful in that it results in rapid attack, producing rust of unprotected A1S1 403 stainless steel.

In this specification and the appended claims, where percentage, proportion or ratio is stated, it is with reference to the weight basis unless otherwise specified.

I claim:

1. The method of making a steel gas turbine engine compressor blade having a duplex coating qualifying the blade for use in corrosive environments which comprises the steps of coating the blade with a slurry consisting essentially of aluminum particles in a liquid vehicle containing chromic acid and phosphoric acid, drying the aluminum coating, curing the aluminum coating, burnishing the aluminum coating by glass bead blasting the aluminum particles into a coherent body of substantially uniform thickness between about 0.2 mil and 2 mils in electrically conductive contact with the steel surface of the blade and providing a cover of ceramic by forming a porous skeletal ceramic on the aluminum coating, impregnating the porous ceramic with a solution of chromium compound capable of being converted to an oxide on being heated, drying and curing the resulting impregnated ceramic, and repeating the impregnation and curing steps to harden and densify the ceramic.

2. The method of claim 1 in which each ceramic curing step is carried out by heating the impregnated porous ceramic to a temperature between 500° F. and 600° F. until conversion of the chromium compound to oxide is substantially complete.

* * * * *